US006182620B1

(12) United States Patent
Cristiani et al.

(10) Patent No.: US 6,182,620 B1
(45) Date of Patent: Feb. 6, 2001

(54) INTERNAL COMBUSTION ENGINE WITH ELECTROMAGNETICALLY ACTUATED VALVES

(75) Inventors: Marcello Cristiani, Imola; Andrea Davitti, Turin; Carlo Orlandi, Stienta, all of (IT)

(73) Assignee: Magneti Marelli S.p.A., Milan (IT)

( * ) Notice: Under 35 U.S.C. 154(b), the term of this patent shall be extended for 0 days.

(21) Appl. No.: 09/409,880

(22) Filed: Oct. 1, 1999

(30) Foreign Application Priority Data

Oct. 2, 1998 (IT) ..... BO98A0560

(51) Int. Cl.[7] ..... F01L 9/04
(52) U.S. Cl. ..... 123/90.11; 123/90.14
(58) Field of Search ..... 123/90.11, 90.12, 123/90.13

(56) References Cited

U.S. PATENT DOCUMENTS

Re. 36,499 * 1/2000 Feucht ..... 123/90.12
5,277,222 1/1994 Clarke ..... 137/495
5,709,178 * 1/1998 Feucht ..... 123/90.12

FOREIGN PATENT DOCUMENTS 35 29 768 A1 2/1987 (DE) .
0 897 059 A2 2/1999 (EP) .
2 236 444 12/1998 (GB) .

* cited by examiner

*Primary Examiner*—Weilun Lo
(74) *Attorney, Agent, or Firm*—Venable; Gabor J. Kelemen

(57) ABSTRACT

An internal combustion engine with electromagnetically actuated valves comprising a variable volume combustion chamber, at least one suction duct connecting the combustion chamber with the suction manifold of the engine and at least one exhaust duct connecting the combustion chamber with the exhaust manifold of the engine, the internal combustion engine further comprising, for each suction and exhaust duct, a respective mushroom valve that can move from and to a closed position in which it closes the duct and an electromagnetic actuator adapted on command to move the valve to and from the closed position, the internal combustion engine further comprising, for at least one of the valves, a device for balancing the pressures exerted on the head of the valve and adapted to balance the pressure forces that tend to oppose the opening of this valve.

6 Claims, 1 Drawing Sheet

INTERNAL COMBUSTION ENGINE WITH ELECTROMAGNETICALLY ACTUATED VALVES

The present invention relates to an internal combustion engine with electromagnetically actuated valves.

BACKGROUND OF THE INVENTION

As is known, tests are currently being conducted on internal combustion engines, in which the suction and exhaust valves which selectively bring the combustion chamber of the engine into communication with the suction manifold and the exhaust manifold of the engine are actuated by electromagnetic actuators driven by an electronic control unit. This solution makes it possible to vary lift, opening time and moment of opening or closing of the valves as a function of the angular velocity of the crankshaft and of other operating parameters of the engine, thereby substantially increasing its performance.

Unfortunately, the internal combustion engines currently being tested have the major drawback that they require extremely powerful electromagnetic actuators whose weight and dimensions means that they are difficult to mount on the head of the engine. Moreover, the use of high power electromagnetic actuators makes it necessary to mount a large-dimension electrical generator, able to satisfy the massive demand for electricity, on the internal combustion engine, with prohibitive production costs.

The use of high power electromagnetic actuators is dictated by the need to exert axial forces of high value on the suction and exhaust valves. At specific operating moments of the engine, the electromagnetic actuator must be able to generate an axial force able to overcome not just the inertia of the valve but also the force exerted on the valve by the gases contained in the combustion chamber.

Considering, for instance, the instants preceding the opening of the exhaust valve, the combusted gases in the combustion chamber have a pressure of some 8 bar which act on the valve head and oppose its opening; if the electromagnetic actuator acting on the exhaust valve is therefore to be able to open the exhaust valve and bring the combustion chamber into communication with the exhaust manifold, it must produce a force equal to the product of the pressure on the head of the exhaust valve.

The value of the force exerted by the combusted gases on the exhaust valve is so high that in the internal combustion engines currently being tested, use is being made of electromagnetic actuators with powers that are much greater than 2 kW, a value which is in itself very high considering existing weight and space limits.

SUMMARY OF THE INVENTION

The object of the present invention is to provide an internal combustion engine with electromagnetically actuated valves that can use low power electromagnetic actuators, in order to remedy the above-described drawbacks.

The present invention therefore relates to an internal combustion engine with electromagnetically actuated valves comprising a variable volume combustion chamber, at least one suction duct connecting the combustion chamber with a suction manifold of the engine and at least one exhaust duct connecting the combustion chamber with an exhaust manifold of the engine, the internal combustion engine further comprising, for each suction and exhaust duct, a respective valve that can move from and to a closed position in which it closes the duct and an electromagnetic actuator adapted on command to move the valve to and from this closed position, the internal combustion engine being characterised in that it comprises, for at least one of these valves, means for balancing the pressures exerted on the valve which are adapted to balance the pressure forces that tend to oppose the opening of this valve.

DETAILED DESCRIPTION OF THE INVENTION

Figure 1:
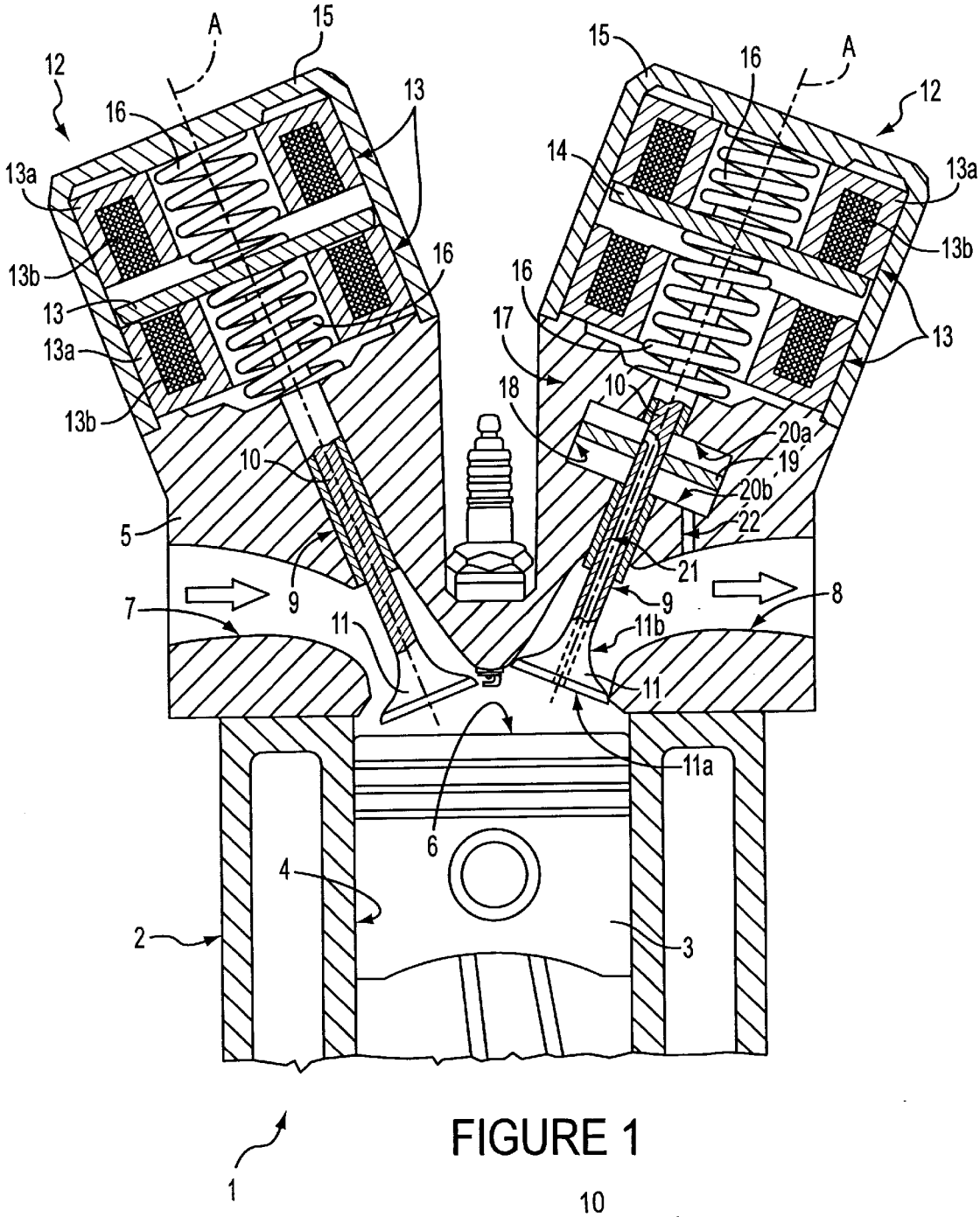
FIG. 1 is a sectional elevation of a preferred embodiment of the invention.

In FIG. 1, an internal combustion engine is shown overall by 1 and comprises a block 2, one or a plurality of pistons 3 mounted in an axially sliding manner in respective cylindrical cavities 4 obtained in the body of the block 2 and a head 5 disposed on the apex of the block 2 to close the cylindrical cavities 4.

In the respective cylindrical cavity 4, each piston 3 bounds, together with the head 5, a variable volume combustion chamber 6, while the head 5 is provided, for each combustion chamber 6, with at least one suction duct 7 and at least one exhaust duct 8 adapted to connect the combustion chamber 6 respectively with the suction manifold and the exhaust manifold of the engine 1, both of known type and not shown.

In FIG. 1, the engine 1 is further provided with a group of electromagnetically actuated valves adapted to regulate the flow of air into the combustion chamber 6 via the suction duct 7 and the flow of combusted gases from the combustion chamber 6 via the exhaust duct 8.

The engine 1 in particular has, at the intake of each duct, whether a suction duct 7 or an exhaust duct 8, a respective mushroom valve 9 of known type, which is mounted on the head 5 so as to have its stem 10 sliding axially through the body of the head 5 and its head 11 moving axially at the intake of the duct to and from a closed position in which it closes the intake of this duct in a leak-tight manner. The valves 9 positioned at the intake of the suction ducts 7 are commonly known as "suction valves", while the valves 9 positioned at the intake of the exhaust ducts 8 are commonly known as "exhaust valves".

The engine 1 comprises, for each suction valve 9 and each exhaust valve 9, a respective electromagnetic actuator 12 adapted axially to displace the stem 10 of the valve 9 so as to move the head 11 from and to its 20 closed position. The electromagnetic actuators 12 are driven by an electronic control unit (not shown) and, in the embodiment shown, are positioned on the head 5 on the side opposite the block 2, each coaxial with respect to the stem 10 of the valve 9 that they have to move.

In the embodiment shown in FIG. 1, each electromagnetic actuator 12 comprises two toroidal electromagnets 13 disposed in alignment along the axis A of the stem 10 of the valve 9 at a predetermined distance from one another, a disk 14 of ferromagnetic material disposed coaxially to the axis A between the two electromagnets 13 and an outer protective housing 15 within which the two toroidal electromagnets 13 and the disk 14 are housed. The outer housing 15 is obviously secured to the head 5 of the engine 1.

The two electromagnets 13 are both formed by an outer magnetic core 13*a* of ferromagnetic material which has a toroidal shape with a substantially U-shaped cross-section and by a coil 13*b* of electrically conducting material wound within the outer magnetic core 13*a*. The two electromagnets 13 are both oriented such that the corresponding coil 13*b* directly faces the disk 14 whose function is alternately to complete the magnetic circuit of the two electromagnets 13.

The disk 14 is secured to the free end of the stem 10 and can be axially moved under the action of the magnetic field generated alternatively by the two toroidal electromagnets 13 between a first operating position in which the disk 14 is disposed in abutment on the electromagnet 13 disposed behind the head 5 and a second operating position in which the disk 14 is disposed in abutment on the electromagnet 13 disposed on the opposite side of the head 5 with respect to this disk 14. It will be appreciated that when the disk 14 is in the first operating position the electric current circulates in the electromagnet disposed behind the head 5, whereas when the disk 14 is in the second operating position, the electric current circulates in the electromagnet 13 disposed on the opposite side of the head 5 with respect to the disk 14.

When the disk 14 is in the first operating position, the head 11 of the valve 9 projects out of the intake of the duct and the valve 9 is thus in the open position; when, however, the disk 14 is in the second operating position, the head 11 engages the intake of the duct in a leak-tight manner and the valve 9 is therefore in the closed position.

In the embodiment shown, each electromagnetic actuator 12 is also provided with two substantially identical helical springs 16 disposed coaxially to the axis A, each within a respective electromagnet 13. These springs 16 have a first end in abutment on the disk 14 and a second end in abutment on the surface of the head 5 or on the base of the outer housing 15 and are adapted to facilitate the displacement of the disk 14 from the first to the second operating position and vice versa.

For each electromagnetic actuator 12 relative to an exhaust valve 9, the engine 1 lastly comprises a device 17 for balancing the pressures exerted on the head 11 of the valve 9, which is adapted to balance the pressure forces that tend to oppose the opening of the valve 9 during the normal operation of the engine 1. These pressure forces are essentially due to the fact that the side 11*a* of the head 11 of the valve 9 facing the combustion chamber 6 is subject, during the instants preceding the opening of the valve 9, to a pressure differing from the pressure on the side 11*b* of the head 11 facing the interior of the exhaust duct 8.

The balancing device 17 is formed, in the embodiment shown, by a compensation chamber 18 provided inside the head 5 coaxially to the axis A of the stem 10 of the valve 9 on which the device is adapted to act, and by a piston 19 mounted in an axially sliding manner in this compensation chamber 18. This piston 19 is keyed on the stem 10 of the valve 9 on which the balancing device 17 is adapted to act and defines, in this chamber 18, two complementary variable volume semi-chambers 20*a* and 20*b*.

One of the two semi-chambers 20*a* and 20*b* communicates with the combustion chamber 6 and the other with the exhaust duct 8, via respective ducts 21 and 22, such that the same pressures as on the sides 11*a* and 11*b* of the head 11 of the exhaust valve 9 act on the two sides of the piston 19.

In particular, in order to balance the effects of the pressure forces, the semi-chamber 20*a* that increases its volume when the valve 9 is moved into the open position must be in communication with the combustion chamber 6, while the semi-chamber 20*b* which reduces its volume when the valve 9 is displaced into the open position must be in communication with the exhaust duct 8. It will be appreciated that, in order to achieve optimum balancing, the chamber 18 must be formed such that the crown of the piston 19 has a surface area smaller than or equal to that of each of the two sides 11*a* and 11*b* of the head 11 of the valve 9.

In order to simplify the connection of the semi-chamber 20*a* with the combustion chamber, the duct 21 may advantageously be obtained within the stem 10 of the valve 9.

It will be appreciated that the balancing device 17 may possibly be positioned outside the head 5, for instance on the apex of the electromagnetic actuator 12.

According to a first variant (not shown), the engine 1 may also be provided with a balancing device 17 for each of the electromagnetic actuators 12 that actuate the suction valves 9.

Figure 2:
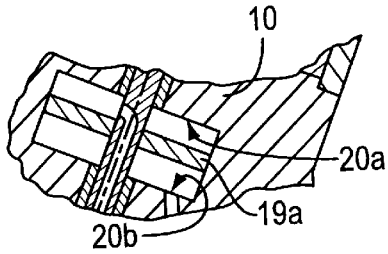
FIG. 2 is a sectional elevational detail of FIG. 1, showing a variant.

According to a further variant shown in FIG. 2, the piston 19 may be replaced by an elastically deformable diaphragm 19*a*. The surface area of the diaphragm must obviously be within the same dimensional criteria to which the piston 19 is subject.

The operation of the engine 1 can be readily deduced from the above description and does not therefore require further explanation.

The engine 1 as described and illustrated has the undoubted advantage that it can use electromagnetic actuators 12 of a power substantially lower than that of the electromagnetic actuators currently in use, without imposing complicated changes on the structure of the engine. The incorporation of the balancing device 17 in the engine architecture is relatively simple and does not require major modifications of production plant.

It will also be appreciated that modifications and variations may be made to the engine 1 as described and illustrated without thereby departing from the scope of the present invention.

What is claimed is:

1. An internal combustion engine (1) with electromagnetically actuated valves comprising a variable volume combustion chamber (6), at least one suction duct (7) connecting the combustion chamber (6) with a suction manifold of the engine and at least one exhaust duct (8) connecting the combustion chamber (6) with an exhaust manifold of the engine, the internal combustion engine (1) further comprising, for each suction (7) and exhaust (8) duct, a respective valve (9) that can move to and from a closed position in which it closes this duct and an electromagnetic actuator (12) adapted on command to move the valve (9) to and from the closed position, the internal combustion engine (1) being characterised in that it comprises, for at least one of the valves (9), means (17) for balancing combustion pressures exerted on the valve (9) which are adapted to balance combustion pressure forces that tend to oppose the opening of this valve (9).

2. An internal combustion engine as claimed in claim 1, characterised in that the balancing means (17) comprises a compensation chamber (18) and a divider member (19) adapted to define within this compensation chamber (18) two complementary variable volume semi-chambers (20*a*, 20*b*), one of these semi-chambers (20*a*, 20*b*) being in communication with the combustion chamber (6) and the other with the exhaust duct (8), the divider member (19) being connected to the valve (9) in order to exert on this valve (9) a feedback force such as to balance the pressure forces acting on the valve (9).

3. An internal combustion engine as claimed in claim 2, characterised in that the divider member (19) is a piston (19) mounted in an axially sliding manner in the balancing chamber (18).

4. An internal combustion engine as claimed in claim 2, characterised in that the divider member (19) is an elastically deformable diaphragm disposed in the balancing chamber (18).

5. An internal combustion engine as claimed in claim 3, further comprising a head (5) in which the suction (7) and exhaust (8) ducts are formed, the valves (9) being mushroom valves mounted with their stem (10) sliding axially through the head (5), the compensation chamber (18) of the balancing means (17) being formed within the head (5) substantially coaxially to the stem (10) of the corresponding valve (9) and the divider member (19) of the balancing means (17) being secured to the stem (10) of the valve (9).

6. An internal combustion engine as claimed in claim 5, characterised in that one **(20*a*) of the two variable volume semi-chambers (20*a*, 20*b*) is in communication with the combustion chamber (6) via a connection duct (20) formed in the stem (10) of the valve (9)**.

* * * * *